US009924807B1

(12) United States Patent
Richter

(10) Patent No.: US 9,924,807 B1
(45) Date of Patent: Mar. 27, 2018

(54) WALKER ASSEMBLY

(71) Applicant: Corey Lee Richter, Barrie (CA)

(72) Inventor: Corey Lee Richter, Barrie (CA)

( * ) Notice: Subject to any disclaimer, the term of this patent is extended or adjusted under 35 U.S.C. 154(b) by 0 days.

(21) Appl. No.: 15/489,550

(22) Filed: Apr. 17, 2017

(51) Int. Cl.
*A63G 1/12* (2006.01)
*A47D 13/04* (2006.01)
*A61H 3/04* (2006.01)

(52) U.S. Cl.
CPC ..... *A47D 13/043* (2013.01)

(58) Field of Classification Search
CPC ..... A61H 3/00; A61H 3/04; A61H 3/008; A61H 2201/1215; A61H 2201/1635; A61H 2201/1642; A61H 2201/164; A61H 2201/165; A63B 21/4034; A63B 2208/0204; A63G 1/12; A63G 1/14
USPC ..... 472/14–15; 482/66–69; 297/344.1
See application file for complete search history.

(56) References Cited

U.S. PATENT DOCUMENTS 368,477 A 8/1887 Lane et al.
451,128 A 4/1891 Lawson
554,179 A * 2/1896 Gerl ..... A47D 13/043 472/15
592,569 A 10/1897 Lehmann
671,058 A * 4/1901 Resetar ..... A47D 13/043 108/139
3,049,350 A * 8/1962 Walker ..... A47D 13/043 297/299
3,171,651 A 3/1965 Merdich et al.
4,549,732 A 10/1985 Hoffman
5,050,504 A 9/1991 Mulcaster
5,211,607 A 5/1993 Fermaglish et al.
5,302,163 A * 4/1994 Fermaglich ..... A47D 13/043 297/137
D355,629 S 2/1995 Kulesza
5,409,437 A 4/1995 Lauro et al.
5,433,682 A * 7/1995 Fermaglich ..... A47D 13/04 135/67
5,522,782 A 6/1996 Kurtin et al.
6,001,047 A 12/1999 Ferrara
(Continued)

FOREIGN PATENT DOCUMENTS

GB 661535 11/1951

OTHER PUBLICATIONS

"3-Way Entertainer(R) Activity Center—Cartoon Cow Pattern", http://www.babysupermall.com/main/products/gra/gra04297.html, retrieved from the internet on Feb. 18, 2002. Webpage no longer available.

(Continued)

*Primary Examiner* — Kien Nguyen

(57) ABSTRACT

An apparatus includes a stationary walker assembly configured for use by a person. The stationary walker assembly includes a stationary base assembly. A first track is configured to be connectable to the stationary base assembly. A second track is configured to be connected to the stationary base assembly. The first track and the second track are spaced apart from each other once the first track and the second track are connected to the stationary base assembly. A yoke assembly is configured to be coupled to the first track and the second track. The yoke assembly is also configured to receive and support the person. This is done in such a way that the yoke assembly, in use, facilitates support of the person relative to the stationary base assembly.

31 Claims, 8 Drawing Sheets

(56) References Cited

U.S. PATENT DOCUMENTS

| | | | |
|---|---|---|---|
| 7,097,599 | B2 | 8/2006 | Gates |
| 2007/0265144 | A1 | 11/2007 | Jackson et al. |

OTHER PUBLICATIONS

"UltraSaucer(TM) Exercise and Entertainment Center", http://www.babysupermall.com/maint/products/eve/eve12407.html, retrieved from the internet on Feb. 18, 2002. Webpage no longer available.

"Walk Around (TM) Rotating Walker and Entertainment Center", http://www.babysupermall.com/main/products/eve/eve123739.html, retrieved from the internet on Feb. 18, 2002. Webpage no longer available.

* cited by examiner

WALKER ASSEMBLY

TECHNICAL FIELD

This document relates to the technical field of (and is not limited to) a walker assembly configured to receive and support a person in such a way that the walker assembly, in use, facilitates support of the person while the person walks (and method therefor).

BACKGROUND

A mobile baby walker is a device that can be used by infants who cannot walk on their own to move from one place to another along the ground or floor. Known mobile baby walkers have a base sitting on top of wheels and a suspended fabric seat with two leg holes.

Other types of mobile walkers include a walking frame configured for use by disabled or elderly people who need additional support to maintain balance or stability while the person walks along the ground or the floor. The mobile walker is mounted on wheels.

SUMMARY

It will be appreciated that there exists a need to mitigate (at least in part) at least one problem associated with the existing walkers (also called the existing technology). After much study of the known systems and methods with experimentation, an understanding of the problem and its solution has been identified and is articulated as follows:

The walker or the baby walker have also led to many preventable injuries. These include injuries from falling down stairs while moving around in the baby walker, often with injuries that are worse than typical for falling down the stairs. Parents are discouraged from using baby walkers.

By way of example, a walker is disclosed in U.S. Pat. No. 5,302,163 (titled INFANT EXERCISER AND ACTIVITY CENTER, published 12 Apr. 1994, in which the inventors are Daniel R. Fermaglich, et al.).

Referring to FIG. 13 of U.S. Pat. No. 5,302,163, a user (a child) is required to move a tray when he/she walks with support from the walker. This may be awkward or cumbersome for the user by imposing a level of difficulty for the user as the user attempts to walk.

What may be required (to mitigate the above drawback) is a walker configured to permit the user to not have to move anything other than a yoke assembly (which is configured to support the person) when they walk with assistance provided by the walker.

Referring to FIG. 13 of U.S. Pat. No. 5,302,163, a user is required to sit (in a seated position), and to shuffle his/her legs in order to walk while sitting in the walker.

What may be required (to mitigate the above drawback) is a walker configured to permit the user to stand upright while the user walks with support from the walker, so that the user may learn to walk (in the standing orientation).

Referring to FIG. 13 of U.S. Pat. No. 5,302,163, the weight of the user is received (at least in part) by a tray. The tray is configured to be slide rotatable relative to stationary columns that extend from a base unit. The peripheral outer edge of the tray may have a relatively higher slide resistance when the tray is rotated by the user. The user may be required to rotate the tray when the user desires to walk (by siting and shuffling their feet). Therefore, it may be relatively difficult for the user to rotate and/or to turn relative to the tray when the user attempts to walk. Moreover, it may be more expensive to add devices for reducing slide resistance for the tray, which may increase the cost of manufacturing the walker.

What may be required (to mitigate the above drawback) is a walker configured to permit the user to employ enough energy to (A) simply move only a yoke assembly (in which the yoke assembly is configured to support the weight of the standing user), and (B) preferably nothing else other than the weight of the user. A technical advantage of this arrangement is the relative ease for the user to move the yoke assembly that is relatively light weight (without having to move other unnecessary weight). This arrangement makes it relatively easier for the user to walk while standing.

Referring to FIG. 13 of U.S. Pat. No. 5,302,163, the entire outer peripheral of a yoke assembly is slide rotatable relative to, and engageable with, a tray. The peripheral outer edge of the yoke assembly has relatively higher slide resistance when the yoke assembly is rotated by the user (relative to the tray). Therefore, it may be relatively difficult for the user to rotate and/or turn in the yoke assembly. Moreover, it may be more expensive to add devices for reducing resistance, which may increase the cost of manufacturing the walker.

What may be required (to mitigate the above drawback) is a walker configured to permit the contact surfaces (between the side edges of the handrails and the outer peripheral edges of a yoke assembly) to be relatively smaller. A technical advantage of this arrangement is reduced sliding resistance between the yoke assembly and a set of opposed handrails (as a result of minimizing the slide contact surfaces between the yoke assembly and the handrails). This arrangement may make it relatively easier for the user to rotate the yoke relative to a base assembly.

Referring to FIG. 13 of U.S. Pat. No. 5,302,163, for the case where a user is facing along a radial direction (toward or away from a central portion of a tray), the user may become stuck (not mobile), and unable to move in a circular fashion (path). The tray may become a barrier to permitting the child to walk while the child is supported by the walker.

What may be required (to mitigate the above drawback) is a walker configured to permit the user to be more motivated to move along the open space of the circular track (the continuous track) making the child less likely to be become stuck, immobile or unable to walk with support from the walker.

By way of example, a walker is disclosed in U.S. Pat. No. 5,433,682 (titled INFANT EXERCISER AND ACTIVITY CENTER, published 18 Jul. 1995, in which the inventors are Daniel R. Fermaglich, et al.).

Referring to FIG. 1 of U.S. Pat. No. 5,433,682, wheels are mounted to the bottom section of the columns, and the wheels permit the columns to be movable over a surface. The wheels and the movable columns are more likely to fail after prolonged use.

What may be required (to mitigate the above drawback) is a walker having columns fixedly connected to a stationary base (this is done in such a way that the columns are stationary relative to the stationary base, and therefore the columns are not movable). A technical advantage of this arrangement is a prolonged working life for the walker as a result of the columns having relatively longer product life when compared to the wheels mounted to the columns (as disclosed in U.S. Pat. No. 5,433,682). In addition, clean up may be relatively easier since there are no wheels attached to the bottom section of the column.

Referring to FIG. 1 of U.S. Pat. No. 5,433,682, the rotatable center column is utilized for supporting a central rotatable shaft, which is more likely to fail after prolonged use. Movable parts tend to fail relatively quicker compared to stationary parts or components.

What may be required (to mitigate the above drawback) is a walker configured to include a center column that is affixed to (and extends from) a stationary base. A technical advantage of this arrangement is a prolonged working life of the walker since the stationary central column is more likely not to fail. Stationary parts tend to not fail compared to movable parts or components. Preferably, there is a single movable part that the child is required to move while walking in the walker (which is the yoke assembly configured to receive and support the child, with the remaining parts remaining, preferably, relatively stationary).

Referring to FIG. 1 of U.S. Pat. No. 5,433,682, the tray (of the walker) is configured to move along with a user. Therefore, the user is required to push or pull (move) more weight when user is in motion, which adds difficulty for the user that is learning to walk. In addition, the user is required to move the column. This arrangement makes the situation more difficult and challenging for the user learning to walk or to be mobile in the walker.

What may be required (to mitigate the above drawback) is a walker configured to reduce the burden on a moving user. A technical advantage of this arrangement is that by reducing the weight that the user is required to move, the walker makes things relatively easier for the user to learn to walk. Preferably, the burden is lowered for the user by providing a single movable lighter-weight part, which is the yoke assembly configured to support the user (while the remaining parts remain relatively stationary). Therefore, less weight for user to push when user is in motion make things easier for the user to learn to walk (with support provided by the walker).

By way of example, a walker is disclosed in U.S. Pat. No. 5,522,782 (titled APPARATUS FOR SUPPORTING A SMALL CHILD ADAPTED TO ALLOW LINEAR AND ROTATIONAL MOVEMENT, published 4 Jun. 1996, in which the inventors are Dragan Kurtin, et al).

Referring to FIG. 3 of U.S. Pat. No. 5,522,782, the user walks in a direction that is not a continuous loop or circuit. Moreover, the user is required to learn to turn around and walk back and forth along a linear (straight) path, which is not convenient or easy for the user (such as a child) to maneuver. Disadvantageously, the user is required to learn to turn around (in the walker) in order to continue to walk back and forth along the linear path, once the user reaches the end point of travel along the linear (straight) path.

What may be required (to mitigate the above drawback) is a walker configured to reduce the burden for the user by permitting the user to be relatively freer to walk along a single continuous direction (a continuous loop or continuous circuit). A technical advantage of this arrangement is that the user is not required to learn to turn around (while walking) in order to continue walking along the path associated with the walker (since the user never reaches an end point because there is no end point of travel for a continuous loop). An advantage of the circular track (versus the linear track) is that the user, such as a toddler or child, learns to walk more easily. Toddlers don't know how to turn around, and so the linear track provides a disadvantage for the toddler learning to walk. With the circular (curved) track, the toddler is not hampered by the dead end of a linear track (the toddler does not know how to turn around at the dead end of a linear track). Advantageously, with the circular track, the toddler may continue walking unimpeded.

Referring to FIG. 3 of U.S. Pat. No. 5,522,782, a yoke assembly (for supporting the user) has long sliding portions configured to engage opposed handrails. It may be very easy for the yoke assembly to become jammed with the handrails (thus preventing user from moving or walking).

What may be required (to mitigate the above drawback) is a walker configured to reduce the burden on the child by providing a curved yoke assembly, which may allow relatively easier movement for the child, which may reduce the possibility of the yoke assembly becoming jammed up, inadvertently preventing the user from moving).

It will be appreciated that there exists a need to mitigate (at least in part) at least one problem associated with the existing walkers (also called the existing technology). After much study of the known systems and methods with experimentation, an understanding of the problem and its solution has been identified and is articulated as follows:

The walker or the baby walker have also led to many preventable injuries. These include injuries from falling down stairs while moving around in the baby walker, often with injuries that are worse than typical for falling down the stairs. Parents are discouraged from using baby walkers.

To mitigate, at least in part, at least one problem associated with the existing technology, there is provided (in accordance with a major aspect) an apparatus, which includes a stationary walker assembly configured for use by a person. The stationary walker assembly includes a stationary base assembly configured to be positioned (either directly or indirectly) on a working surface (this is done in such a way that the stationary base assembly is not movable relative to the working surface once the stationary base assembly is positioned on the working surface). A first track is configured to be connectable to (either directly or indirectly), and to be spaced apart from, the stationary base assembly (this is done in such a way that the first track is positioned above the stationary base assembly once the first track is connected to the stationary base assembly). A second track is configured to be connected to (either directly or indirectly), and spaced apart from, the stationary base assembly (this is done in such a way that the second track is positioned above the stationary base assembly once the second track is connected to the stationary base assembly). The first track and the second track are spaced apart from each other once the first track and the second track are connected to the stationary base assembly (this is done in such a way that the first track and the second track, in combination, form a walking path extending between the first track and the second track). A yoke assembly is configured to couple (either directly or indirectly) to the first track and the second track. The yoke assembly is also configured to receive (either directly or indirectly) and support (either directly or indirectly) the person. This is done in such a way that the yoke assembly, in use, facilitates support of the person relative to the stationary base assembly while the person, in use, walks relative to the stationary base assembly.

To mitigate, at least in part, at least one problem associated with existing technology, there is provided (in accordance with a major aspect) a method for using a stationary walker assembly. The method includes: (A) positioning a stationary base assembly on a working surface (this is done in such a way that the stationary base assembly is not movable relative to the working surface once the stationary base assembly is positioned on the working surface), (B) connecting a first track to, and spacing the first track apart from, the stationary base assembly (this is done in such a way that the first track is positioned above the stationary base assembly once the first track is connected to the stationary base assembly), (C) connecting a second track to, and spacing the second track apart from, the stationary base assembly (this is done in such a way that the second track is positioned above the stationary base assembly once the second track is connected to the stationary base assembly), (D) spacing the first track and the second track apart from each other once the first track and the second track are connected to the stationary base assembly (this is done in such a way that the first track and the second track, in combination, form a walking path extending between the first track and the second track), (E) coupling a yoke assembly to the first track and the second track, and (F) receiving and supporting the person in the yoke assembly (this is done in such a way that the yoke assembly, in use, facilitates support of the person relative to the stationary base assembly while the person, in use, walks relative to the stationary base assembly).

A technical effect of the above apparatus and method is that the stationary walker assembly, in use, permits the person to walk along the stationary base assembly, and whereby the person is not permitted to walk along the floor or the ground (since the stationary base assembly is placed on the ground or the floor). In this manner, the person is less likely to be exposed to the dangers associated with the known (existing) mobile walkers that cause injuries when the mobile walker permits the person to fall down the stairs while the person (baby) moves around in the mobile walker. As a result, for instance, with the above arrangement, parents would be encouraged to use the stationary walker assembly.

Other aspects are identified in the claims. Other aspects and features of the non limiting embodiments may now become apparent to those skilled in the art upon review of the following detailed description of the non limiting embodiments with the accompanying drawings. This Summary is provided to introduce concepts in simplified form that are further described below in the Detailed Description. This Summary is not intended to identify key features or essential features of the disclosed subject matter, and is not intended to describe each disclosed embodiment or every implementation of the disclosed subject matter. Many other novel advantages, features, and relationships will become apparent as this description proceeds. The figures and the description that follow more particularly exemplify illustrative embodiments.

BRIEF DESCRIPTION OF THE DRAWINGS

The non limiting embodiments may be more fully appreciated by reference to the following detailed description of the non limiting embodiments when taken in conjunction with the accompanying drawings, in which.

Figure 1:
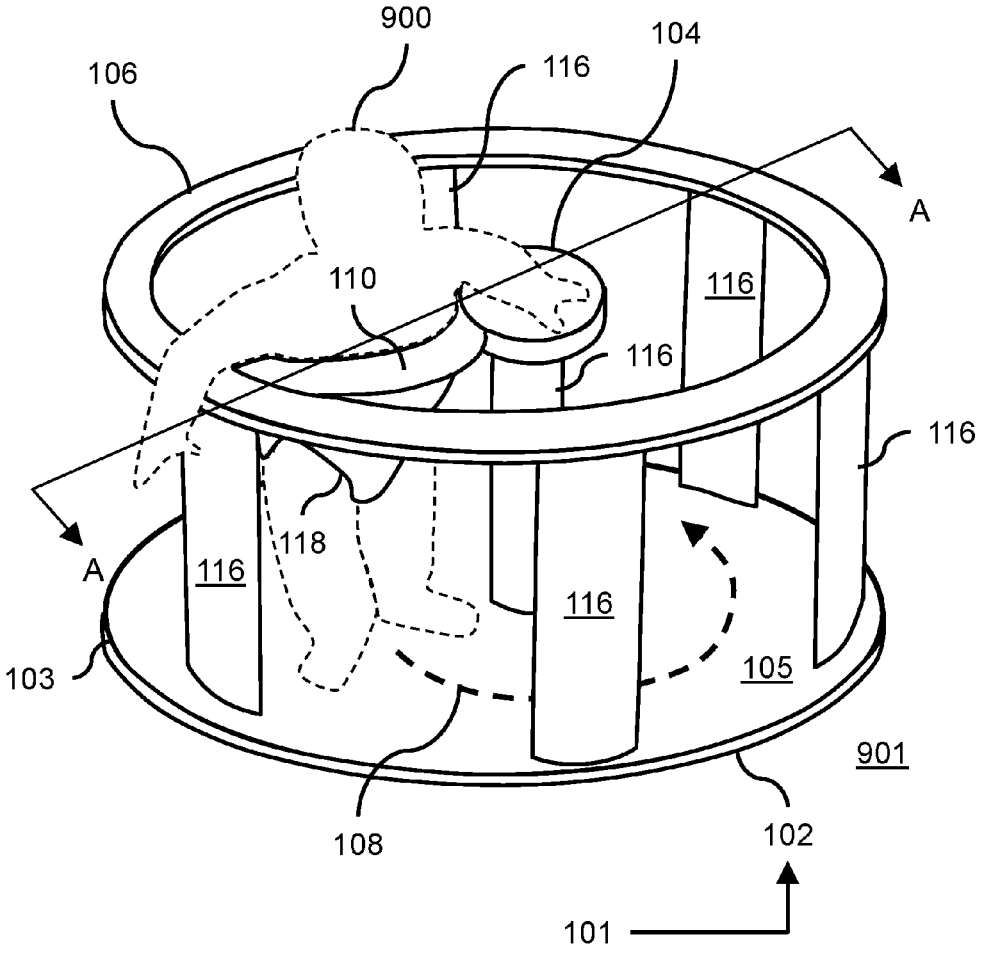
FIG. 1 depicts a front perspective view of an embodiment of a stationary walker assembly configured for use by a person.

The drawings are not necessarily to scale and may be illustrated by phantom lines, diagrammatic representations and fragmentary views. In certain instances, details unnecessary for an understanding of the embodiments (and/or details that render other details difficult to perceive) may have been omitted. Corresponding reference characters indicate corresponding components throughout the several figures of the drawings. Elements in the several figures are illustrated for simplicity and clarity and have not been drawn to scale. The dimensions of some of the elements in the figures may be emphasized relative to other elements for facilitating an understanding of the various disclosed embodiments. In addition, common, but well-understood, elements that are useful or necessary in commercially feasible embodiments are often not depicted to provide a less obstructed view of the embodiments of the present disclosure.

LISTING OF REFERENCE NUMERALS USED IN THE DRAWINGS

101 stationary walker assembly
102 stationary base assembly
103 outer peripheral edge
104 first track
105 walking surface
106 second track
108 walking path
110 yoke assembly
112 yoke rotation axis
114 activity center
116 column assembly
118 receiver assembly
120 leg openings
122 first peripheral groove
123 second peripheral groove
124 friction-reduction element
126 latch assembly
128 telescoping column
130 rotatable member
900 person
901 working surface

DETAILED DESCRIPTION OF THE NON LIMITING EMBODIMENT(S)

The following detailed description is merely exemplary and is not intended to limit the described embodiments or the application and uses of the described embodiments. As used, the word "exemplary" or "illustrative" means "serving as an example, instance, or illustration." Any implementation described as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure. The scope of may be defined by the claims (in which the claims may be amended during patent examination after filing of this application). For the description, the terms "upper," "lower," "left," "rear," "right," "front," "vertical," "horizontal," and derivatives thereof shall relate to the examples as oriented in the drawings. There is no intention to be bound by any expressed or implied theory in the preceding Technical Field, Background, Summary or the following detailed description. It is also to be understood that the devices and processes illustrated in the attached drawings, and described in the following specification, are exemplary embodiments (examples), aspects and/or concepts defined in the appended claims. Hence, dimensions and other physical characteristics relating to the embodiments disclosed are not to be considered as limiting, unless the claims expressly state otherwise. It is understood that the phrase "at least one" is equivalent to "a". The aspects (examples, alterations, modifications, options, variations, embodiments and any equivalent thereof) are described regarding the drawings. It should be understood that the invention is limited to the subject matter provided by the claims, and that the invention is not limited to the particular aspects depicted and described.

FIG. 1 depicts a front perspective view of an embodiment of a stationary walker assembly 101 configured for use by a person 900. Referring to the embodiment as depicted in FIG. 1, and in accordance with a general aspect, an apparatus includes (and is not limited to) the stationary walker assembly 101 configured to be used (either directly or indirectly) by a person 900. The person 900 is preferably a child or toddler, etc. The person 900 may include a person of any age (child, teenager, adult, senior citizen, a person recovering from an injury, etc.).

The stationary walker assembly 101 includes (and is not limited to) a synergistic combination of a stationary base assembly 102, a first track 104, a second track 106, and a yoke assembly 110.

The stationary base assembly 102 is configured to be positioned (either directly or indirectly) on a working surface 901. This is done in such a way that the stationary base assembly 102 is not movable relative to the working surface 901 once the stationary base assembly 102 is positioned (either directly or indirectly) on the working surface 901. The stationary base assembly 102 forms (provides) a walking surface 105 (a planar surface or flat surface). A technical effect of the above arrangement is that the stationary walker assembly 101, in use, permits the person 900 to walk along a stable surface so that the person 900 may avoid unwanted injury, and whereby safety of the person 900 is improved.

The first track 104 is configured to be connectable (either directly or indirectly) to the stationary base assembly 102. The first track 104 is also configured to be spaced apart from the stationary base assembly 102 once the first track 104 is connected (affixed, either directly or indirectly) to the stationary base assembly 102. This is done in such a way that the first track 104 is positioned (either directly or indirectly) above the stationary base assembly 102 once the first track 104 is connected (either directly or indirectly) to the stationary base assembly 102.

The second track 106 is configured to be connected (either directly or indirectly) to the stationary base assembly 102. The second track 106 is also configured to be spaced apart from the stationary base assembly 102 once the second track 106 is connected (affixed, either directly or indirectly) to the stationary base assembly 102. This is done in such a way that the second track 106 is positioned (either directly or indirectly) above the stationary base assembly 102 once the second track 106 is connected (either directly or indirectly) to the stationary base assembly 102.

The first track 104 and the second track 106 are spaced apart from each other once the first track 104 and the second track 106 are connected (either directly or indirectly) to the stationary base assembly 102. This is done in such a way that the first track 104 and the second track 106, in combination, form a walking path 108 extending (either directly or indirectly) between the first track 104 and the second track 106.

The yoke assembly 110 is configured to couple (either directly or indirectly) to the first track 104 and the second track 106. The yoke assembly 110 is also configured to receive (either directly or indirectly) and support (at least in part, either directly or indirectly) the person 900. This is done in such a way that the yoke assembly 110, in use, facilitates support (either directly or indirectly) of the person 900 relative to the stationary base assembly 102 while the person 900, in use, walks on (along) the stationary base assembly 102.

A technical effect of the above arrangement is that the stationary walker assembly 101, in use, permits the person 900 to walk along the stationary base assembly 102, and whereby the person 900 is not permitted to walk along the floor or the ground (since the stationary base assembly 102 is placed on the ground or the floor). In this manner, the person 900 is less likely to be exposed to the dangers associated with the known (existing) mobile walkers that cause injuries when the mobile walker permits the person to fall down the stairs while the person (baby) moves around in the mobile walker. As a result, for instance, with the above arrangement, parents would be encouraged to use the stationary walker assembly 101.

In accordance with an embodiment, the apparatus is adapted such that the yoke assembly 110 is also configured to be located between the first track 104 and the second track 106. The yoke assembly 110 is also configured to slidably engage with the first track 104 and the second track 106. This is done in such a way that the yoke assembly 110 is slidable relative to the first track 104 and the second track 106 once the yoke assembly 110 is slidably engaged with the first track 104 and the second track 106. A technical effect of the above arrangement is that the yoke assembly 110 confines the movement of the person 900 along a predetermined walking path that is known to be safe for the person 900 while the person 900 uses the stationary walker assembly 101.

In accordance with an embodiment, the apparatus is adapted such that the first track 104, the second track 106 and the yoke assembly 110, in combination, are configured to support the person 900 once the yoke assembly 110 is slidably engaged with the first track 104 and the second track 106, and once the yoke assembly 110 receives the person 900. This is done in such a way that the yoke assembly 110 is movable along the walking path 108 in response to the person 900 walking along the walking path 108. A technical effect of the above arrangement is that the combination of the first track 104, the second track 106 and the yoke assembly 110, in use, support the person 900 in a position located above the stationary base assembly 102 and within the physical confines of the stationary base assembly 102.

In accordance with a preferred embodiment, the first track 104 is configured to provide (form) a first handrail configured to be touched by the hand (hands) of the person 900 (once the person 900 is received in, and is supported by, the yoke assembly 110). The second track 106 is configured to provide (form) a second handrail configured to be touched by the hand (hands) of the person 900 (once the person 900 is received in, and is supported by, the yoke assembly 110). A technical effect of the above arrangement is that the combination of the first handrail and the second hand rail improves ergonomic fit of the stationary walker assembly 101 to the person 900.

In accordance with a preferred embodiment, the stationary walker assembly 101 further includes at least one spaced-apart column assembly 116 or spaced-apart column assemblies 116 (hereafter referred to as the column assembly 116 for ease of description). The column assemblies 116 are configured to extend between the first track 104 and the stationary base assembly 102. The column assemblies 116 are configured to connect the first track 104 to the stationary base assembly 102. The column assemblies 116 are configured to extend vertically once the column assemblies 116, in use, connect the first track 104 to the stationary base assembly 102. Preferably, at least one of the column assemblies 116 (or at least two or more column assemblies 116) extends between the first track 104 and the stationary base assembly 102. A technical effect of the above arrangement is that the column assemblies 116 improves ergonomic fit of the stationary walker assembly 101 to the person 900.

The column assemblies 116 are also configured to extend between the second track 106 and the stationary base assembly 102. The column assemblies 116 are configured to connect the second track 106 to the stationary base assembly 102. The column assemblies 116 are configured to extend vertically once the column assemblies 116, in use, connect the second track 106 to the stationary base assembly 102. A technical effect of the above arrangement is that the column assemblies 116, in use, improve ergonomic fit of the stationary walker assembly 101 to the person 900.

Preferably, at least one of the column assemblies 116 (or at least two or more column assemblies 116) extends between the second track 106 and the stationary base assembly 102.

In accordance with a preferred embodiment, the yoke assembly 110 is configured to surround the waist area of the person 900. The yoke assembly 110 is configured to be coupled to a receiver assembly 118 (also called a holder or a suspended fabric seat). The receiver assembly 118 is configured to receive and to support the person 900 (relative to the stationary base assembly 102) in such a way that the feet of the person 900, in use, touches the walking surface 105 of the stationary base assembly 102. A technical effect of the above arrangement is that the receiver assembly 118 improves ergonomic fit of the stationary walker assembly 101 to the person 900 and/or avoids unwanted injury to the person 900.

In accordance with an option, the receiver assembly 118 is configured to be rotatable relative to the yoke assembly 110. In accordance with another option, the receiver assembly 118 is configured to be non rotatable relative to the yoke assembly 110. The yoke assembly 110 is also configured to permit the hands of the person 900 to touch (contact) the first track 104 and the second track 106 (once the person 900 is received and is supported by the yoke assembly 110).

The yoke assembly 110 is also configured to permit the feet of the person 900 to touch the stationary base assembly 102 while the yoke assembly 110 prevents the person 900 from falling to the stationary base assembly 102 (once the person 900 is received and is supported by the yoke assembly 110). A technical effect of the above arrangement is that the yoke assembly 110 improves ergonomic fit of the stationary walker assembly 101 to the person 900 and/or avoids unwanted injury to the person 900.

Preferably, the stationary base assembly 102 provides the walking surface 105, in which the person 900 may touch the walking surface 105 with their feet (once the person 900 is received in the yoke assembly 110). Preferably, the stationary base assembly 102 includes a central base section. The stationary base assembly 102 defines an outer peripheral edge 103 that is spaced apart from the central base section of the stationary base assembly 102. The stationary base assembly 102 defines (includes) an outer peripheral edge 103 that is spaced apart from the central base section of the stationary base assembly 102. The first track 104 is positioned above the central base section of the stationary base assembly 102. A technical effect of the above arrangement is that the first track 104 improves the usage of the stationary walker assembly 101 by the person 900 relative to the stationary base assembly 102.

In accordance with a preferred embodiment, the first track 104 and the second track 106 each form a curved shape (circular shape). Preferably, the first track 104 is positioned concentrically relative to the second track 106. A technical effect of the above arrangement is that the stationary walker assembly 101 provides a circular walking path for the person 900 walk along, whereby the person 900 may view the surroundings of the room for improved enjoyment.

Preferably, the assemblies or components of the stationary walker assembly 101 are made of plastic (a light weight plastic material), wood, etc., and any equivalent thereof. The assemblies or components of the stationary walker assembly 101 may be held together (connected together) by attachment mechanisms (known and not depicted) or may be friction fitted relative to each other, etc. The assemblies or components of the stationary walker assembly 101 may be manufactured using an injection molding system.

Preferably, the stationary walker assembly 101 is configured to include columns (vertically extending columns) that are fixedly connected to the stationary base assembly 102. This is done in such a way that the columns are stationary relative to the stationary base assembly 102; therefore, the columns are not movable. A technical advantage of this arrangement is a prolonged working life for the stationary walker assembly 101 as a result of the columns having relatively longer product life. In addition, clean up (of the stationary walker assembly 101) may be relatively easier since there are no wheels attached to the bottom section of the columns. The stationary walker assembly 101 is configured to include a central column 116 that is affixed to the stationary base assembly 102. A technical advantage of this arrangement is a prolonged working life for the stationary walker assembly 101 since the central column 116 is more likely to have a longer product life. Stationary parts tend to not fail compared to movable parts or components. Preferably, there is a single movable part, which is the yoke assembly 110 configured to receive and support the child, and the remaining parts are (preferably) relatively stationary. The stationary walker assembly 101 is configured to reduce the burden on a moving child. A technical advantage of this arrangement is that by reducing the weight that the child is required to move, the stationary walker assembly 101 makes it relatively easier for the child to learn to walk. Preferably, the burden is lowered for the child by providing a single movable lighter-weight part, which is the yoke assembly 110 (configured to support the child), while the remaining parts remain relatively stationary. Therefore, less weight for child to push (when the child is in motion) makes things easier for the child to learn to walk.

Preferably, the stationary walker assembly 101 is configured to reduce the burden on the child by permitting the child to be relatively freer to walk along a single continuous direction (a continuous loop or continuous circuit). A technical advantage of this arrangement is that the child is not required to learn to turn around in order to continue walking along the path associated with the walker because the child never reaches an end point (there is no end point of travel for a continuous loop). An advantage of the circular track (versus the linear track) is that the toddler (child) learns to walk more easier. Toddlers don't know how to turn around, and so the linear track provides a disadvantage for the toddler learning to walk. With the circular track, the toddler is not hampered by the dead end of a linear track (the toddler does not know how to turn around at the dead end of a linear track). Advantageously, with the circular track, the toddler may continue walking unimpeded. The stationary walker assembly 101 is configured to reduce the burden on the child by providing a curved yoke assembly, which may allow relatively easier movement for the child, and reduce the possibility of the yoke assembly becoming jammed up (and inadvertently preventing the child from moving and/or walking).

Figure 2:
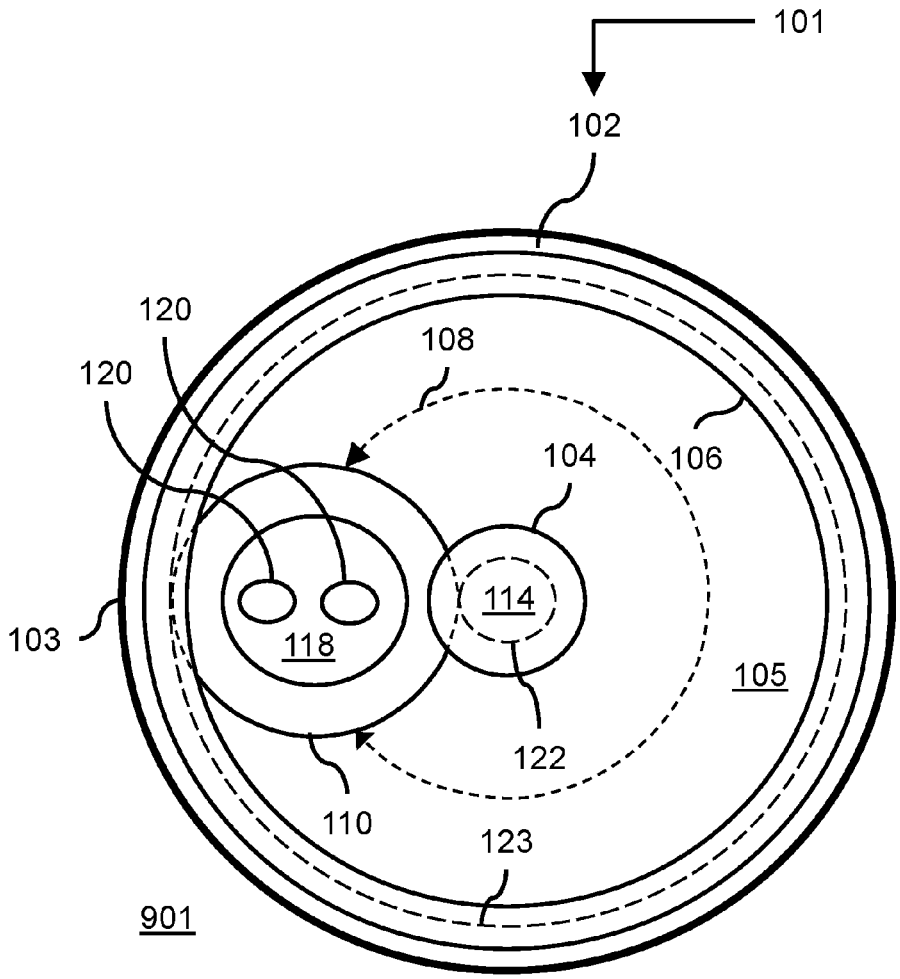
FIG. 2 depicts a top view of an embodiment of the stationary walker assembly of FIG. 1.

FIG. 2 depicts a top view of an embodiment of the stationary walker assembly 101 of FIG. 1. Referring to the embodiment as depicted in FIG. 2, the stationary walker assembly 101 further includes an activity center 114. The activity center 114 is configured to extend upwardly from a central base section of the stationary base assembly 102. The activity center 114 is configured to be integrated with the first track 104. Preferably, the first track 104 is formed in or included with the activity center 114. The activity center 114 is configured to receive, in use, items (baby bottle, toy, etc.). A technical effect of the above arrangement is that the activity center 114 provides additional enjoyment of the stationary walker assembly 101 by the person 900.

In accordance with a preferred embodiment, the yoke assembly 110 is configured to permit movement of the person 900 in such a way that the person 900 may rotate along the yoke rotation axis 112 (depicted in FIG. 8) between a first position in which the person 900 faces the activity center 114, and a second position in which the person 900 faces away from the activity center 114. A technical effect of the above arrangement is that the yoke assembly 110 provides additional and/or flexible enjoyment of the stationary walker assembly 101 by the person 900.

The receiver assembly 118 is configured to form leg openings 120. The leg openings 120 are configured to receive, at least in part, the legs of the person 900. Preferably, the first track 104 defines (provides) a first peripheral groove 122. The second track 106 defines (provides) a second peripheral groove 123.

Preferably, the stationary walker assembly 101 is configured to permit the child (the person 900) to not have to move anything other than the yoke assembly 110 when they walk in the walker. The stationary walker assembly 101 is configured to permit the child (the person 900) to stand while walking, so that the child (the person 900) may learn to walk in a relatively easier manner. The stationary walker assembly 101 is configured to permit the child (the person 900) to employ just enough energy to simply move only the yoke assembly 110 (and preferably nothing else). A technical advantage of this arrangement is the relative ease for the child (the person 900) to move the yoke assembly 110 that is relatively light weight (without having to move other unnecessary weight). The stationary walker assembly 101 is configured to permit the contact surfaces (between the side edges of the hand rails and the outer peripheral edges of the yoke assembly 110) to be relatively smaller. A technical advantage of this arrangement is reduced sliding resistance between the yoke assembly 110 and the handrails as a result of minimizing the slide contact surfaces between the yoke assembly 110 and the handrails. This arrangement may make it relatively easier for the child to rotate the yoke relative to the stationary base assembly 102. The stationary walker assembly 101 is configured to permit the child (the person 900) to be less likely to get stuck since the child (the person 900) is more likely to be motivated to move along the open space of the circular track (the continuous track).

Figure 3:
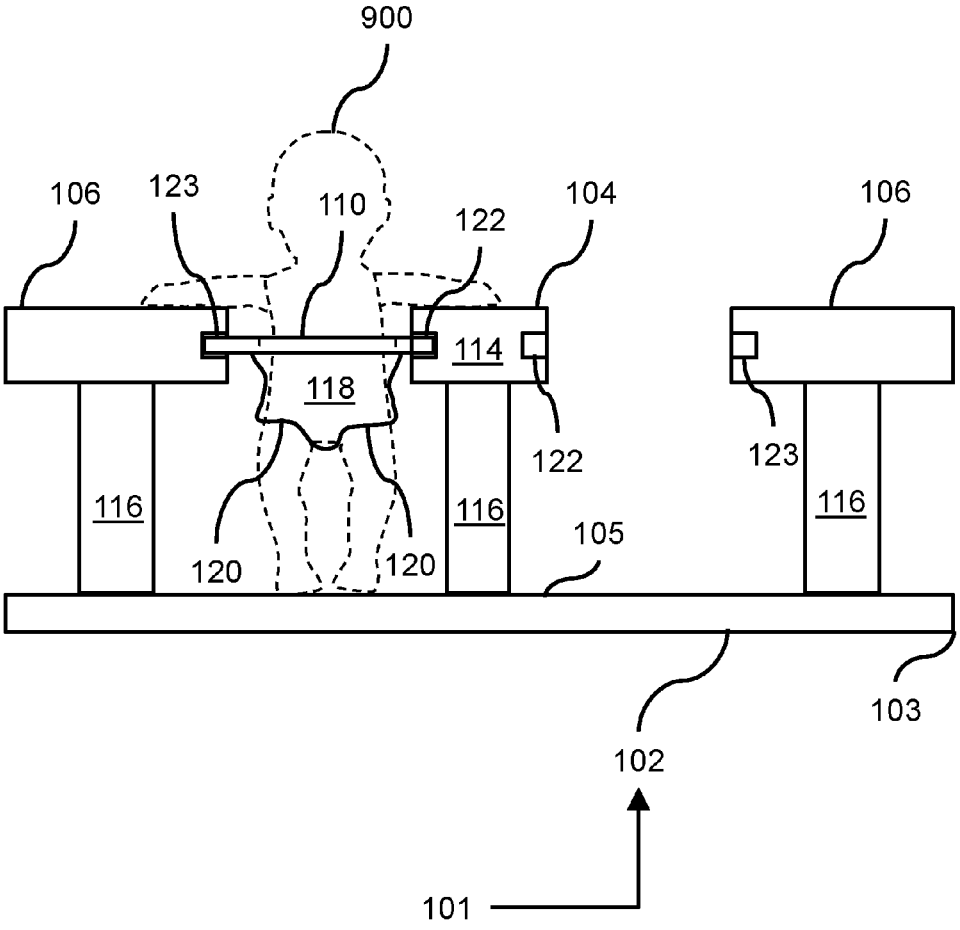
FIG. 3 depicts a cross-sectional view (in which the view is seen through the cross-sectional line A-A of FIG. 1) of an embodiment of the stationary walker assembly of FIG. 1.

FIG. 3 depicts a cross-sectional view (in which the view is seen through the cross-sectional line A-A of FIG. 1) of an embodiment of the stationary walker assembly 101 of FIG. 1. Referring to the embodiment as depicted in FIG. 3, the first peripheral groove 122 and the second peripheral groove 123 face each other (once the first track 104 and the second track 106 are installed relative to the stationary base assembly 102, via the column assemblies 116). The outer peripheral edge of the yoke assembly 110 is configured to be received by, at least in part, or engaged, at least in part, with the first peripheral groove 122 and the second peripheral groove 123. The outer peripheral edge of the yoke assembly 110 is configured to be slidable relative to the first peripheral groove 122 and the second peripheral groove 123 once the outer peripheral edge of the yoke assembly 110 is received by, at least in part, and engaged with, at least in part, the first peripheral groove 122 and the second peripheral groove 123. A technical effect of the above arrangement is that the outer peripheral edge increases the available space on the yoke assembly 110 for use by the person 900.

Figure 4:
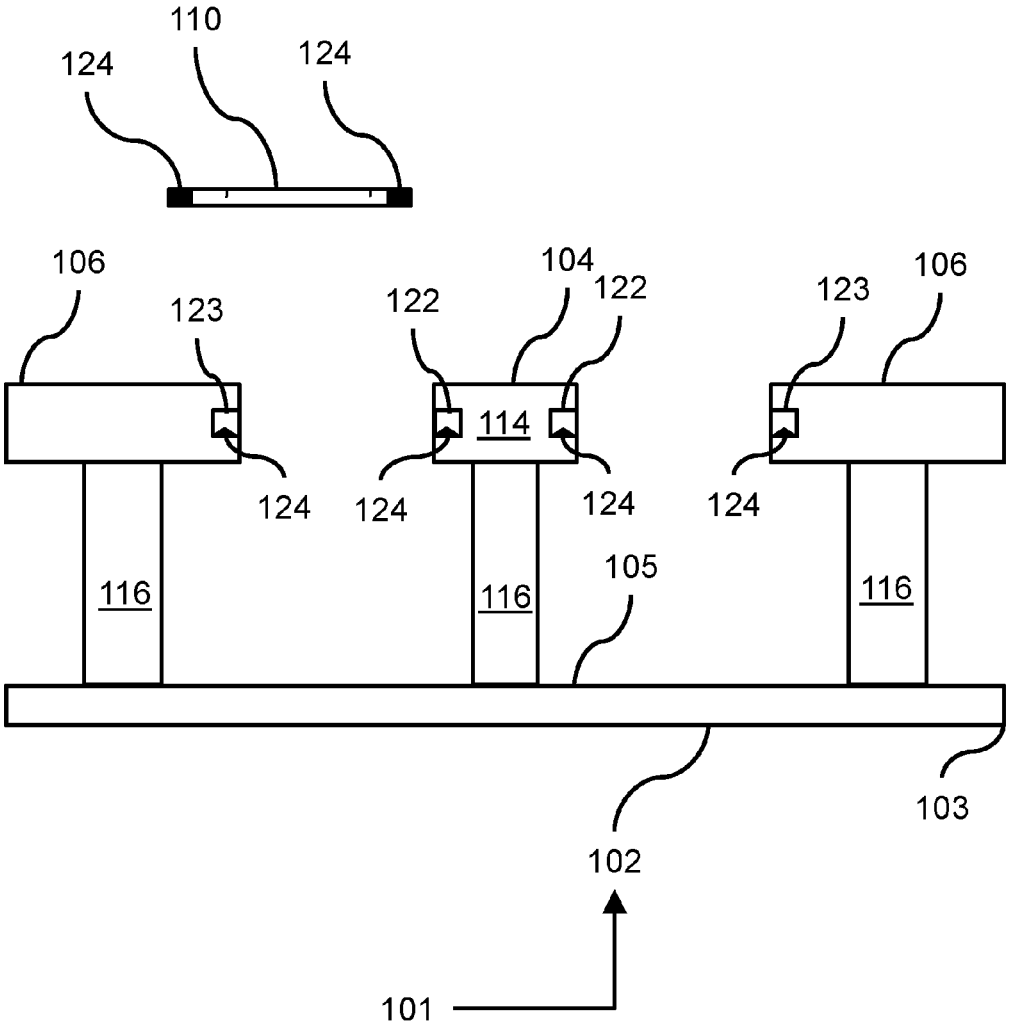
FIG. 4 depicts a cross-sectional view (in which the view is seen through the cross-sectional line A-A of FIG. 1) of an embodiment of the stationary walker assembly of FIG. 1.

FIG. 4 depicts a cross-sectional view (in which the view is seen through the cross-sectional line A-A of FIG. 1) of an embodiment of the stationary walker assembly 101 of FIG. 1. Referring to the embodiment as depicted in FIG. 4, the outer peripheral edge of the yoke assembly 110 includes, at least in part, a friction-reduction element 124 (such as, nylon, etc., and any equivalent thereof). The friction-reduction element 124 is mounted to the first peripheral groove 122. The friction-reduction element 124 is also mounted to the second peripheral groove 123. The friction-reduction element 124 is configured to facilitate movement of the yoke assembly 110 relative to the first peripheral groove 122 (of the first track 104) and to the second peripheral groove 123 (of the second track 106) with relatively less friction. A technical effect of the above arrangement is that the friction-reduction element 124 improves ease of use of the stationary walker assembly 101 for the person 900.

Figure 5:
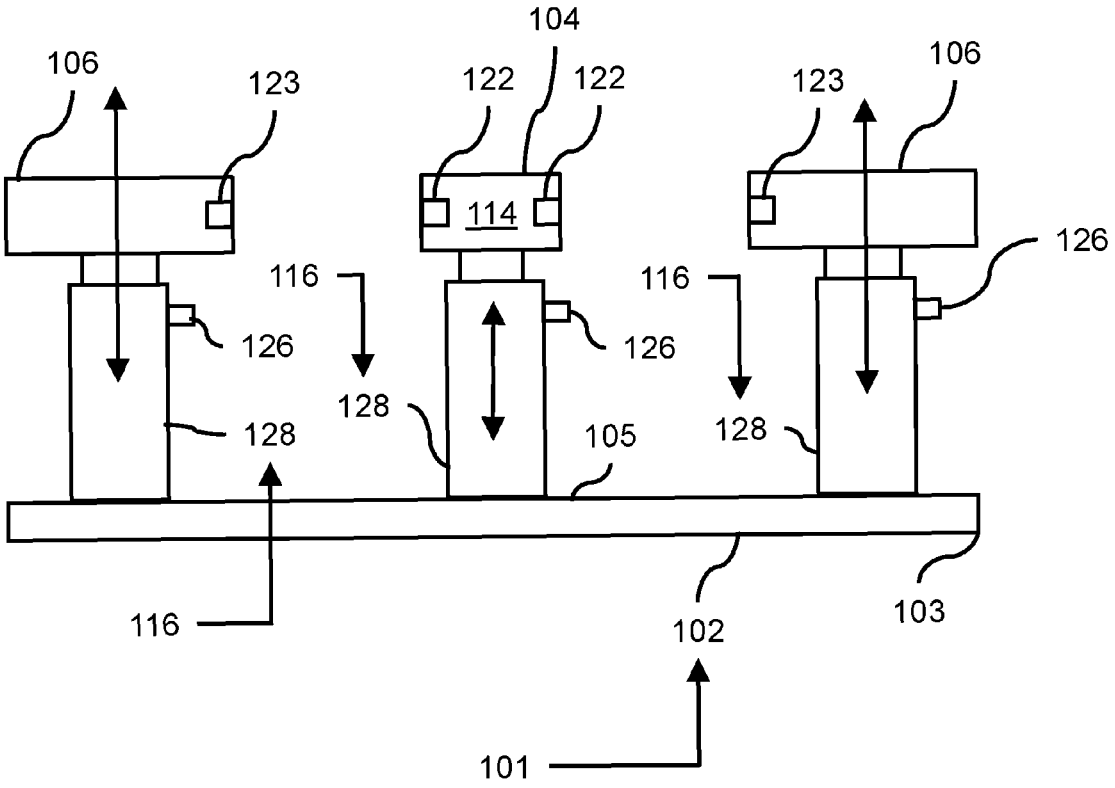
FIG. 5 depicts a cross-sectional view (in which the view is seen through the cross-sectional line A-A of FIG. 1) of an embodiment of the stationary walker assembly of FIG. 1.
Figure 6:
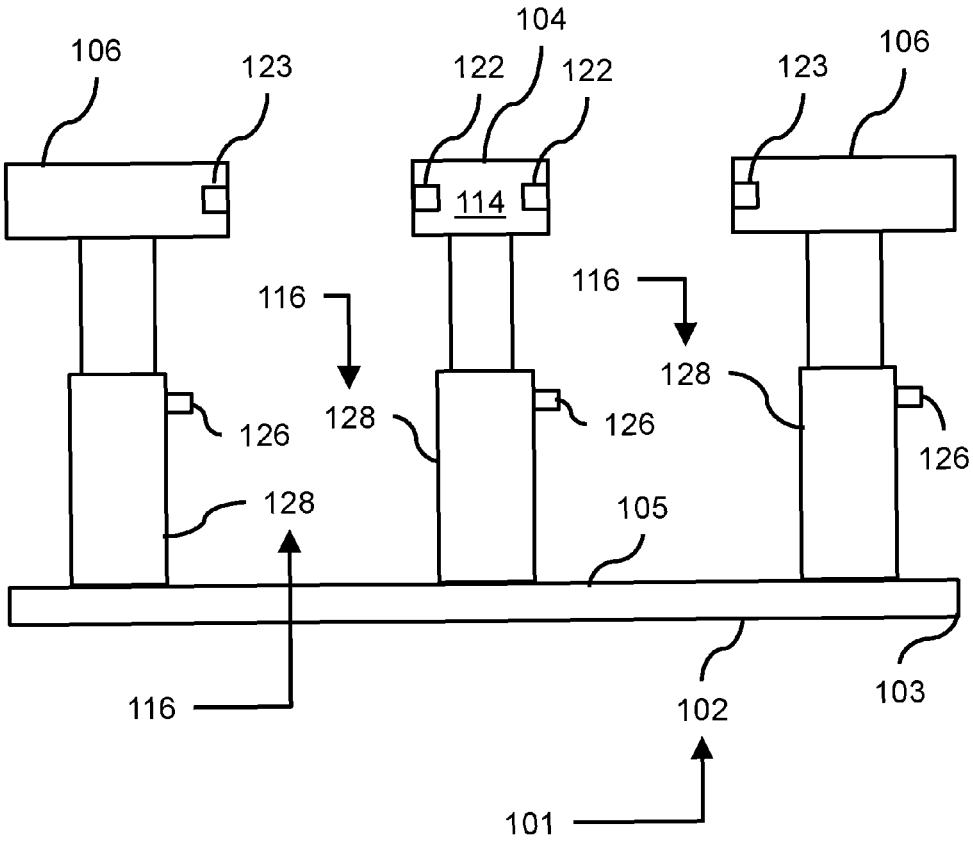
FIG. 6 depicts a cross-sectional view (in which the view is seen through the cross-sectional line A-A of FIG. 1) of an embodiment of the stationary walker assembly of FIG. 1.

FIG. 5 depicts a cross-sectional view (in which the view is seen through the cross-sectional line A-A of FIG. 1) of an embodiment of the stationary walker assembly 101 of FIG. 1. FIG. 6 depicts a cross-sectional view (in which the view is seen through the cross-sectional line A-A of FIG. 1) of an embodiment of the stationary walker assembly 101 of FIG. 1. Referring to the embodiments as depicted in FIG. 5 and FIG. 6, the stationary walker assembly 101 is further adapted such that the column assemblies 116 are configured to provide a telescoping column 128. The telescoping column 128 is configured to support and, selectively move, the first track 104 and the second track 106 between a retracted position (as depicted in FIG. 5) and an extended position (as depicted in FIG. 6). The telescoping column 128 is configured to selectively lengthen (as depicted in FIG. 6) to a relatively longer length, and is also configured to selectively shorten (as depicted in FIG. 5) to a relatively shorter length. This is done in such a way that the telescoping column 128 facilitates ergonomic fit of the first track 104 and the second track 106 relative to the height of the person 900. A technical effect of the above arrangement is that the telescoping column 128 improves ergonomic fit of the stationary walker assembly 101 to the person 900.

Preferably, each of the telescoping columns 128 includes a latch assembly 126 (a spring-loaded latch), which may be called a lock. The latch assembly 126 is configured to selectively latch (lock) the telescoping column 128 in such a way that the length of the telescoping column 128 is fixed (relative to the stationary base assembly 102).

Figure 7:
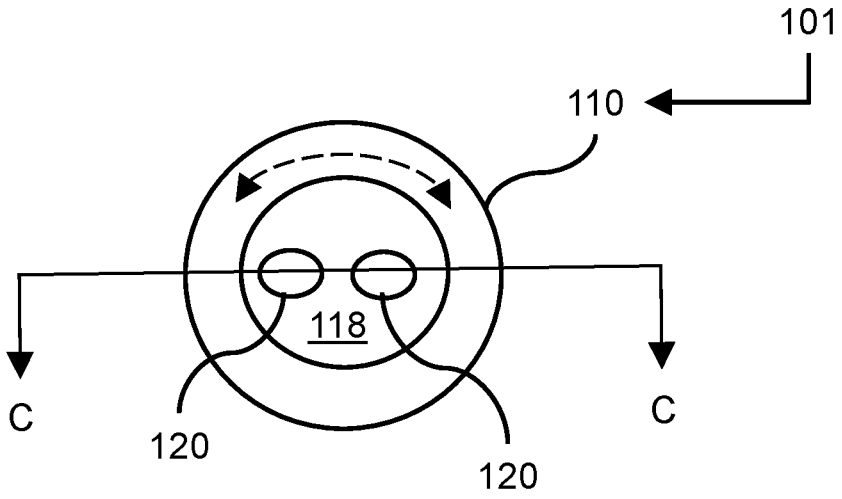
FIG. 7 and FIG. 8 depict a top view (FIG. 7) and a cross-sectional view (FIG. 8, in which the views are seen through the cross-sectional line C-C of FIG. 7) of embodiments of the stationary walker assembly of FIG. 1.
Figure 8:
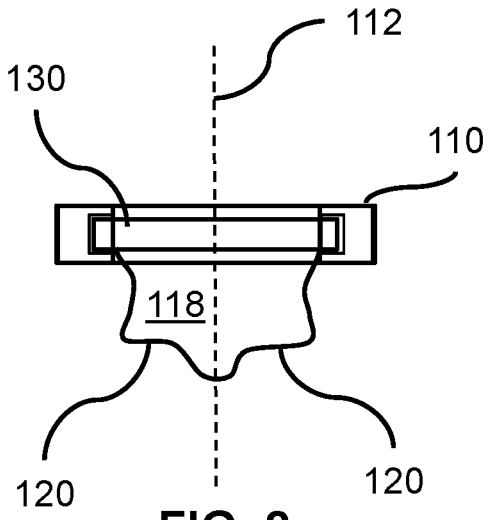

FIG. 7 and FIG. 8 depict a top view (FIG. 7) and a cross-sectional view (FIG. 8, in which the views are seen through the cross-sectional line C-C of FIG. 7) of embodiments of the stationary walker assembly 101 of FIG. 1.

Referring to the embodiment as depicted in FIG. 7, the receiver assembly 118 is configured to be rotatably mounted to the yoke assembly 110.

Referring to the embodiment as depicted in FIG. 8, the yoke assembly 110 includes a yoke rotation axis 112 extending toward the stationary base assembly 102. The yoke assembly 110 is also configured to rotate about the yoke rotation axis 112. The yoke assembly 110 is also configured to permit the person 900 to rotate along the yoke rotation axis 112. Preferably, the yoke assembly 110 forms an interior channel. The yoke assembly 110 further includes a rotatable member 130 configured to be rotatably mounted to the inner channel formed by the yoke assembly 110. The receiver assembly 118 is affixed to the rotatable member 130, and in this manner, the yoke assembly 110 is configured to permit the person 900 to rotate along the yoke rotation axis 112.

Figure 9:
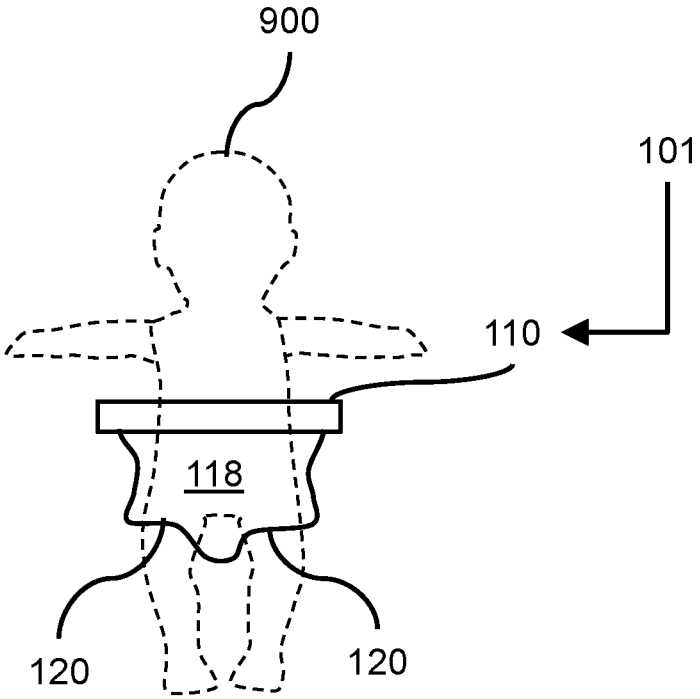
FIG. 9 depicts a cross-sectional view (in which the view is seen through the cross-sectional line C-C of FIG. 7) of embodiments of the stationary walker assembly of FIG. 1.

FIG. 9 depicts a cross-sectional view (in which the view is seen through the cross-sectional line C-C of FIG. 7) of embodiments of the stationary walker assembly 101 of FIG. 1.

Referring to the embodiment as depicted in FIG. 9, preferably, the receiver assembly 118 includes a flexible fabric material, and any equivalent thereof.

It is understood that each claim in the claims section are open ended claims unless stated otherwise. Unless otherwise specified, relational terms used in these specifications should be construed to include certain tolerances that the person skilled in the art would recognize as providing equivalent functionality. By way of example, the term perpendicular is not necessarily limited to about 90.0 degrees, but also to any slight variation thereof that the person skilled in the art would recognize as providing equivalent functionality for the purposes described for the relevant member or element. Terms such as "about" and "substantially", in the context of configuration, relate generally to disposition, location, or configuration that is either exact or sufficiently close to the location, disposition, or configuration of the relevant element to preserve operability of the element within the invention which does not materially modify the invention. Similarly, unless specifically made clear from its context, numerical values should be construed to include certain tolerances that the person skilled in the art would recognize as having negligible importance as they do not materially change the operability of the invention. It will be appreciated that the description and/or drawings identify and describe embodiments of the apparatus (either explicitly or non-explicitly). The apparatus may include any suitable combination and/or permutation of the technical features as identified in the detailed description, as may be required and/or desired to suit a particular technical purpose and/or technical function. It will be appreciated that, where possible and suitable, any one or more of the technical features of the apparatus may be combined with any other one or more of the technical features of the apparatus (in any combination and/or permutation). It will be appreciated that persons skilled in the art would know that technical features of each embodiment may be deployed (where possible) in other embodiments even if not expressly stated as such above. It will be appreciated that persons skilled in the art would know that other options would be possible for the configuration of the components of the apparatus to adjust to manufacturing requirements and still remain within the scope as described in at least one or more of the claims. This written description provides embodiments, including the best mode, and also enables the person skilled in the art to make and use the embodiments. The patentable scope may be defined by the claims. The written description and/or drawings may help to understand the scope of the claims. It is believed that all the crucial aspects of the disclosed subject matter have been provided in this document. It is understood, for this document, that the phrase "includes" is equivalent to the word "comprising." The foregoing has outlined the non limiting embodiments (examples). The description is made for particular non limiting embodiments (examples). It is understood that the non limiting embodiments are merely illustrative as examples.

What is claimed is:

1. An apparatus, comprising:

a stationary walker assembly being configured for use by a person; and the stationary walker assembly comprising:

a stationary base assembly being configured to be positioned on a working surface in such a way that the stationary base assembly is not movable relative to the working surface once the stationary base assembly is positioned on the working surface; and a first track being configured to be connectable to, and also being configured to be spaced apart from, the stationary base assembly in such a way that the first track is positioned above the stationary base assembly once the first track is connected to the stationary base assembly; and a second track being configured to be connected to, and spaced apart from, the stationary base assembly in such a way that the second track is positioned above the stationary base assembly once the second track is connected to the stationary base assembly; and the first track and the second track being spaced apart from each other once the first track and the second track are connected to the stationary base assembly in such a way that the first track and the second track, in combination, form a walking path extending between the first track and the second track; and a yoke assembly being configured to couple to the first track and the second track; and the yoke assembly also being configured to receive and support the person in such a way that the yoke assembly, in use, facilitates support of the person relative to the stationary base assembly while the person, in use, walks on the stationary base assembly; and wherein:

the stationary walker assembly further comprises:

at least one spaced-apart column assembly being configured to provide a telescoping column; and wherein the telescoping column is configured to support and, selectively move, the first track and the second track between a retracted position and an extended position; and the telescoping column includes a latch assembly configured to selectively latch the telescoping column in such a way that a length of the telescoping column is fixed relative to the stationary base assembly.

2. The apparatus of claim 1, wherein:

the yoke assembly is configured to be coupled to a receiver assembly; and wherein the receiver assembly is configured to be rotatably mounted to the yoke assembly in such a way that the person may turn around while the person is held or received in and supported by the yoke assembly; and the stationary walker assembly further comprises:

an activity center being configured to extend upwardly from a central base section of the stationary base assembly; and the activity center being integrated with the first track; and the activity center being configured to receive items; and wherein the yoke assembly is configured to permit movement of the person in such a way that the person may rotate along a yoke rotation axis between a first position in which the person, in use, faces the activity center, and a second position in which the person, in use, faces away from the activity center; and the yoke assembly includes an outer peripheral edge; and the outer peripheral edge includes, at least in part, a friction-reduction element; and wherein the friction-reduction element is mounted to a first peripheral groove provided by the first track; and the friction-reduction element is also mounted to a second peripheral groove provided by the second track; and the friction-reduction element is configured to facilitate movement of the yoke assembly relative to the first peripheral groove of the first track and the second peripheral groove of the second track.

3. The apparatus of claim 1, wherein:

the yoke assembly is configured to be coupled to a receiver assembly; and wherein the receiver assembly is configured to be rotatably mounted to the yoke assembly in such a way that the person may turn around while the person is held or received in and supported by the yoke assembly; and wherein the stationary walker assembly further comprises:

an activity center being configured to extend upwardly from a central base section of the stationary base assembly; and the activity center being integrated with the first track; and the activity center being configured to receive items; and wherein the yoke assembly is configured to permit movement of the person in such a way that the person may rotate along a yoke rotation axis between a first position in which the person, in use, faces the activity center, and a second position in which the person, in use, faces away from the activity center.

4. The apparatus of claim 1, wherein:

the yoke assembly is configured to be coupled to a receiver assembly; and wherein the receiver assembly is configured to be rotatably mounted to the yoke assembly in such a way that the person may turn around while the person is held or received in and supported by the yoke assembly; and wherein the stationary walker assembly further comprises:

an activity center being configured to extend upwardly from a central base section of the stationary base assembly; and the activity center being integrated with the first track; and the activity center being configured to receive items; and wherein the yoke assembly includes an outer peripheral edge; and wherein the outer peripheral edge includes, at least in part, a friction-reduction element; and wherein the friction-reduction element is mounted to a first peripheral groove provided by the first track; and the friction-reduction element is also mounted to a second peripheral groove provided by the second track; and the friction-reduction element is configured to facilitate movement of the yoke assembly relative to the first peripheral groove of the first track and the second peripheral groove of the second track.

5. The apparatus of claim 1, wherein:

the yoke assembly is configured to be coupled to a receiver assembly; and wherein the receiver assembly is configured to be rotatably mounted to the yoke assembly in such a way that the person may turn around while the person is held or received in and supported by the yoke assembly; and wherein the yoke assembly is configured to permit movement of the person in such a way that the person may rotate along a yoke rotation axis between a first position in which the person, in use, faces an activity center, and a second position in which the person, in use, faces away from the activity center; and wherein the yoke assembly includes an outer peripheral edge; and wherein the outer peripheral edge includes, at least in part, a friction-reduction element; and wherein the friction-reduction element is mounted to a first peripheral groove provided by the first track; and the friction-reduction element is also mounted to a second peripheral groove provided by the second track; and the friction-reduction element is configured to facilitate movement of the yoke assembly relative to the first peripheral groove of the first track and the second peripheral groove of the second track.

6. The apparatus of claim 1, wherein:

the stationary walker assembly further comprises:

an activity center being configured to extend upwardly from a central base section of the stationary base assembly; and the activity center being integrated with the first track; and the activity center being configured to receive items; and wherein the yoke assembly is configured to permit movement of the person in such a way that the person may rotate along a yoke rotation axis between a first position in which the person, in use, faces the activity center, and a second position in which the person, in use, faces away from the activity center; and wherein the yoke assembly includes an outer peripheral edge; and the outer peripheral edge includes, at least in part, a friction-reduction element; and wherein the friction-reduction element is mounted to a first peripheral groove provided by the first track; and the friction-reduction element is also mounted to a second peripheral groove provided by the second track; and the friction-reduction element is configured to facilitate movement of the yoke assembly relative to the first peripheral groove of the first track and the second peripheral groove of the second track.

7. The apparatus of claim 1, wherein:

the yoke assembly is configured to be coupled to a receiver assembly; and wherein the receiver assembly is configured to be rotatably mounted to the yoke assembly in such a way that the person may turn around while the person is held or received in and supported by the yoke assembly; and wherein the stationary walker assembly further comprises:

an activity center being configured to extend upwardly from a central base section of the stationary base assembly; and the activity center being integrated with the first track; and the activity center being configured to receive items.

8. The apparatus of claim 1, wherein:

the yoke assembly is configured to be coupled to a receiver assembly; and wherein the receiver assembly is configured to be rotatably mounted to the yoke assembly in such a way that the person may turn around while the person is held or received in and supported by the yoke assembly; and wherein the yoke assembly is configured to permit movement of the person in such a way that the person may rotate along a yoke rotation axis between a first position in which the person, in use, faces an activity center, and a second position in which the person, in use, faces away from the activity center.

9. The apparatus of claim 1, wherein:

the yoke assembly is configured to be coupled to a receiver assembly; and wherein the receiver assembly is configured to be rotatably mounted to the yoke assembly in such a way that the person may turn around while the person is held or received in and supported by the yoke assembly; and wherein the yoke assembly includes an outer peripheral edge; and the outer peripheral edge includes, at least in part, a friction-reduction element; and wherein the friction-reduction element is mounted to a first peripheral groove provided by the first track; and the friction-reduction element is also mounted to a second peripheral groove provided by the second track; and the friction-reduction element is configured to facilitate movement of the yoke assembly relative to the first peripheral groove of the first track and the second peripheral groove of the second track.

10. The apparatus of claim 1, wherein:

the stationary walker assembly further comprises:

an activity center being configured to extend upwardly from a central base section of the stationary base assembly; and the activity center being integrated with the first track; and the activity center being configured to receive items; and wherein the yoke assembly is configured to permit movement of the person in such a way that the person may rotate along a yoke rotation axis between a first position in which the person, in use, faces the activity center, and a second position in which the person, in use, faces away from the activity center.

11. The apparatus of claim 1, wherein:

the stationary walker assembly further comprises:

an activity center being configured to extend upwardly from a central base section of the stationary base assembly; and the activity center being integrated with the first track; and the activity center being configured to receive items; and wherein the yoke assembly includes an outer peripheral edge; and the outer peripheral edge includes, at least in part, a friction-reduction element; and wherein the friction-reduction element is mounted to a first peripheral groove provided by the first track; and the friction-reduction element is also mounted to a second peripheral groove provided by the second track; and the friction-reduction element is configured to facilitate movement of the yoke assembly relative to the first peripheral groove of the first track and the second peripheral groove of the second track.

12. The apparatus of claim 1, wherein:

the yoke assembly is configured to permit movement of the person in such a way that the person may rotate along a yoke rotation axis between a first position in which the person, in use, faces an activity center, and a second position in which the person, in use, faces away from the activity center; and wherein the yoke assembly includes an outer peripheral edge; and the outer peripheral edge includes, at least in part, a friction-reduction element; and wherein the friction-reduction element is mounted to a first peripheral groove provided by the first track; and the friction-reduction element is also mounted to a second peripheral groove provided by the second track; and the friction-reduction element is configured to facilitate movement of the yoke assembly relative to the first peripheral groove of the first track and the second peripheral groove of the second track.

13. The apparatus of claim 1, wherein:

the yoke assembly is configured to be coupled to a receiver assembly; and wherein the receiver assembly is configured to be rotatably mounted to the yoke assembly in such a way that the person may turn around while the person is held or received in and supported by the yoke assembly.

14. The apparatus of claim 1, wherein:

the stationary walker assembly further comprises:

an activity center being configured to extend upwardly from a central base section of the stationary base assembly; and the activity center being integrated with the first track; and the activity center being configured to receive items.

15. The apparatus of claim 1, wherein:

the yoke assembly is configured to permit movement of the person in such a way that the person may rotate along a yoke rotation axis between a first position in which the person, in use, faces an activity center, and a second position in which the person, in use, faces away from the activity center.

16. The apparatus of claim 1, wherein:

the yoke assembly includes an outer peripheral edge; and the outer peripheral edge includes, at least in part, a friction-reduction element; and wherein the friction-reduction element is mounted to a first peripheral groove provided by the first track; and the friction-reduction element is also mounted to a second peripheral groove provided by the second track; and the friction-reduction element is configured to facilitate movement of the yoke assembly relative to the first peripheral groove of the first track and the second peripheral groove of the second track.

17. An apparatus, comprising:

a stationary walker assembly being configured for use by a person; and the stationary walker assembly comprising:

a stationary base assembly being configured to be positioned on a working surface in such a way that the stationary base assembly is not movable relative to the working surface once the stationary base assembly is positioned on the working surface; and a first track being configured to be connectable to, and also being configured to be spaced apart from, the stationary base assembly in such a way that the first track is positioned above the stationary base assembly once the first track is connected to the stationary base assembly; and a second track being configured to be connected to, and spaced apart from, the stationary base assembly in such a way that the second track is positioned above the stationary base assembly once the second track is connected to the stationary base assembly; and the first track and the second track being spaced apart from each other once the first track and the second track are connected to the stationary base assembly in such a way that the first track and the second track, in combination, form a walking path extending between the first track and the second track; and a yoke assembly being configured to couple to the first track and the second track; and the yoke assembly also being configured to receive and support the person in such a way that the yoke assembly, in use, facilitates support of the person relative to the stationary base assembly while the person, in use, walks on the stationary base assembly; and wherein:

the yoke assembly is configured to be coupled to a receiver assembly; and wherein the receiver assembly is configured to be rotatably mounted to the yoke assembly in such a way that the person may turn around while the person is held or received in and supported by the yoke assembly.

18. The apparatus of claim 17, wherein:

the stationary walker assembly further comprises:

an activity center being configured to extend upwardly from a central base section of the stationary base assembly; and the activity center being integrated with the first track; and the activity center being configured to receive items; and wherein the yoke assembly is configured to permit movement of the person in such a way that the person may rotate along a yoke rotation axis between a first position in which the person, in use, faces the activity center, and a second position in which the person, in use, faces away from the activity center; and wherein the yoke assembly includes an outer peripheral edge; and the outer peripheral edge includes, at least in part, a friction-reduction element; and wherein the friction-reduction element is mounted to a first peripheral groove provided by the first track; and the friction-reduction element is also mounted to a second peripheral groove provided by the second track; and the friction-reduction element is configured to facilitate movement of the yoke assembly relative to the first peripheral groove of the first track and the second peripheral groove of the second track.

19. The apparatus of claim 17, wherein:

the stationary walker assembly further comprises:

an activity center being configured to extend upwardly from a central base section of the stationary base assembly; and the activity center being integrated with the first track; and the activity center being configured to receive items; and wherein the yoke assembly is configured to permit movement of the person in such a way that the person may rotate along a yoke rotation axis between a first position in which the person, in use, faces the activity center, and a second position in which the person, in use, faces away from the activity center.

20. The apparatus of claim 17, wherein:

the stationary walker assembly further comprises:

an activity center being configured to extend upwardly from a central base section of the stationary base assembly; and the activity center being integrated with the first track; and the activity center being configured to receive items; and wherein the yoke assembly includes an outer peripheral edge; and the outer peripheral edge includes, at least in part, a friction-reduction element; and wherein the friction-reduction element is mounted to a first peripheral groove provided by the first track; and the friction-reduction element is also mounted to a second peripheral groove provided by the second track; and the friction-reduction element is configured to facilitate movement of the yoke assembly relative to the first peripheral groove of the first track and the second peripheral groove of the second track.

21. The apparatus of claim 17, wherein:

the yoke assembly is configured to permit movement of the person in such a way that the person may rotate along a yoke rotation axis between a first position in which the person, in use, faces an activity center, and a second position in which the person, in use, faces away from the activity center; and wherein the yoke assembly includes an outer peripheral edge; and the outer peripheral edge includes, at least in part, a friction-reduction element; and wherein the friction-reduction element is mounted to a first peripheral groove provided by the first track; and the friction-reduction element is also mounted to a second peripheral groove provided by the second track; and the friction-reduction element is configured to facilitate movement of the yoke assembly relative to the first peripheral groove of the first track and the second peripheral groove of the second track.

22. The apparatus of claim 17, wherein:

the stationary walker assembly further comprises:

an activity center being configured to extend upwardly from a central base section of the stationary base assembly; and the activity center being integrated with the first track; and the activity center being configured to receive items.

23. The apparatus of claim 17, wherein:

the yoke assembly is configured to permit movement of the person in such a way that the person may rotate along a yoke rotation axis between a first position in which the person, in use, faces an activity center, and a second position in which the person, in use, faces away from the activity center.

24. The apparatus of claim 17, wherein:

the yoke assembly includes an outer peripheral edge; and the outer peripheral edge includes, at least in part, a friction-reduction element; and wherein the friction-reduction element is mounted to a first peripheral groove provided by the first track; and the friction-reduction element is also mounted to a second peripheral groove provided by the second track; and the friction-reduction element is configured to facilitate movement of the yoke assembly relative to the first peripheral groove of the first track and the second peripheral groove of the second track.

25. An apparatus, comprising:

a stationary walker assembly being configured for use by a person; and the stationary walker assembly comprising:

a stationary base assembly being configured to be positioned on a working surface in such a way that the stationary base assembly is not movable relative to the working surface once the stationary base assembly is positioned on the working surface; and a first track being configured to be connectable to, and also being configured to be spaced apart from, the stationary base assembly in such a way that the first track is positioned above the stationary base assembly once the first track is connected to the stationary base assembly; and a second track being configured to be connected to, and spaced apart from, the stationary base assembly in such a way that the second track is positioned above the stationary base assembly once the second track is connected to the stationary base assembly; and the first track and the second track being spaced apart from each other once the first track and the second track are connected to the stationary base assembly in such a way that the first track and the second track, in combination, form a walking path extending between the first track and the second track; and a yoke assembly being configured to couple to the first track and the second track; and the yoke assembly also being configured to receive and support the person in such a way that the yoke assembly, in use, facilitates support of the person relative to the stationary base assembly while the person, in use, walks on the stationary base assembly; and wherein:

the stationary walker assembly further comprises:

an activity center being configured to extend upwardly from a central base section of the stationary base assembly; and the activity center being integrated with the first track; and the activity center being configured to receive items.

26. The apparatus of claim 25, wherein:

the yoke assembly is configured to permit movement of the person in such a way that the person may rotate along a yoke rotation axis between a first position in which the person, in use, faces the activity center, and a second position in which the person, in use, faces away from the activity center; and wherein the yoke assembly includes an outer peripheral edge; and the outer peripheral edge includes, at least in part, a friction-reduction element; and wherein the friction-reduction element is mounted to a first peripheral groove provided by the first track; and the friction-reduction element is also mounted to a second peripheral groove provided by the second track; and the friction-reduction element is configured to facilitate movement of the yoke assembly relative to the first peripheral groove of the first track and the second peripheral groove of the second track.

27. The apparatus of claim 25, wherein:

the yoke assembly is configured to permit movement of the person in such a way that the person may rotate along a yoke rotation axis between a first position in which the person, in use, faces the activity center, and a second position in which the person, in use, faces away from the activity center.

28. The apparatus of claim 25, wherein:

the yoke assembly includes an outer peripheral edge; and the outer peripheral edge includes, at least in part, a friction-reduction element; and wherein the friction-reduction element is mounted to a first peripheral groove provided by the first track; and the friction-reduction element is also mounted to a second peripheral groove provided by the second track; and the friction-reduction element is configured to facilitate movement of the yoke assembly relative to the first peripheral groove of the first track and the second peripheral groove of the second track.

29. An apparatus, comprising:

a stationary walker assembly being configured for use by a person; and the stationary walker assembly comprising:

a stationary base assembly being configured to be positioned on a working surface in such a way that the stationary base assembly is not movable relative to the working surface once the stationary base assembly is positioned on the working surface; and a first track being configured to be connectable to, and also being configured to be spaced apart from, the stationary base assembly in such a way that the first track is positioned above the stationary base assembly once the first track is connected to the stationary base assembly; and a second track being configured to be connected to, and spaced apart from, the stationary base assembly in such a way that the second track is positioned above the stationary base assembly once the second track is connected to the stationary base assembly; and the first track and the second track being spaced apart from each other once the first track and the second track are connected to the stationary base assembly in such a way that the first track and the second track, in combination, form a walking path extending between the first track and the second track; and a yoke assembly being configured to couple to the first track and the second track; and the yoke assembly also being configured to receive and support the person in such a way that the yoke assembly, in use, facilitates support of the person relative to the stationary base assembly while the person, in use, walks on the stationary base assembly; and wherein:

the yoke assembly is configured to permit movement of the person in such a way that the person may rotate along a yoke rotation axis between a first position in which the person, in use, faces an activity center, and a second position in which the person, in use, faces away from the activity center.

30. The apparatus of claim 29, wherein:

the yoke assembly includes an outer peripheral edge; and the outer peripheral edge includes, at least in part, a friction-reduction element; and wherein the friction-reduction element is mounted to a first peripheral groove provided by the first track; and the friction-reduction element is also mounted to a second peripheral groove provided by the second track; and the friction-reduction element is configured to facilitate movement of the yoke assembly relative to the first peripheral groove of the first track and the second peripheral groove of the second track.

31. An apparatus, comprising:

a stationary walker assembly being configured for use by a person; and the stationary walker assembly comprising:

a stationary base assembly being configured to be positioned on a working surface in such a way that the stationary base assembly is not movable relative to the working surface once the stationary base assembly is positioned on the working surface; and a first track being configured to be connectable to, and also being configured to be spaced apart from, the stationary base assembly in such a way that the first track is positioned above the stationary base assembly once the first track is connected to the stationary base assembly; and a second track being configured to be connected to, and spaced apart from, the stationary base assembly in such a way that the second track is positioned above the stationary base assembly once the second track is connected to the stationary base assembly; and the first track and the second track being spaced apart from each other once the first track and the second track are connected to the stationary base assembly in such a way that the first track and the second track, in combination, form a walking path extending between the first track and the second track; and a yoke assembly being configured to couple to the first track and the second track; and the yoke assembly also being configured to receive and support the person in such a way that the yoke assembly, in use, facilitates support of the person relative to the stationary base assembly while the person, in use, walks on the stationary base assembly; and wherein:

the yoke assembly includes an outer peripheral edge; and the outer peripheral edge includes, at least in part, a friction-reduction element; and wherein the friction-reduction element is mounted to a first peripheral groove provided by the first track; and the friction-reduction element is also mounted to a second peripheral groove provided by the second track; and the friction-reduction element is configured to facilitate movement of the yoke assembly relative to the first peripheral groove of the first track and the second peripheral groove of the second track.

* * * * *